United States Patent [19]

Takada

[11] Patent Number: 4,483,610

[45] Date of Patent: Nov. 20, 1984

[54] METHOD OF CLEANING A TRANSFER MATERIAL SUPPORTING MEMBER IN AN IMAGE FORMING APPARATUS

[75] Inventor: Yusaku Takada, Tokyo, Japan

[73] Assignee: Canon Kabushiki Kaisha, Tokyo, Japan

[21] Appl. No.: 528,115

[22] Filed: Aug. 31, 1983

[30] Foreign Application Priority Data

Sep. 7, 1982 [JP] Japan ..... 57-155664

[51] Int. Cl.[3] ..... G03G 21/00

[52] U.S. Cl. ..... 355/15; 118/652; 430/126

[58] Field of Search ..... 355/15, 3 TR, 14 TR, 355/4 SH; 118/652; 430/126

[56] References Cited

U.S. PATENT DOCUMENTS 3,819,263 6/1974 Draugelis ..... 355/17

*Primary Examiner*—John D. Welsh

*Attorney, Agent, or Firm*—Fitzpatrick, Cella, Harper & Scinto

[57] ABSTRACT

The present invention relates to the drive and control of a device for cleaning transfer material supporting member, the cleaning device being adapted to operate only when corona dischargers disposed opposite the transfer material supporting member are not in operation, whereby toner particles scattered upon the operation of the cleaning device is prevented from depositing on the surrounding parts under the influence of corona discharging.

7 Claims, 4 Drawing Figures

METHOD OF CLEANING A TRANSFER MATERIAL SUPPORTING MEMBER IN AN IMAGE FORMING APPARATUS

BACKGROUND OF THE INVENTION

1. Field of the Invention

The present invention relates to an image recording apparatus of such a type that a transfer material is supported on transfer material supporting means and transferably receives a toner image from an image bearing member, and more particularly to the cleaning of the transfer material supporting means and the operation of corona dischargers relating to the cleaning step.

2. Description of the Prior Art

In the conventional image transfer type electrophotographic image forming systems such as copying machines, a transfer material is supported on a drum or belt-shaped transfer material supporting member. The transfer material and the supporting member are synchronously moved close to or in contact with an image bearing member such as a photosensitive drum or the like. As the transfer material supporting member is used for an increased time period, it is more contaminated by the toner particles conveyed on the image bearing member. Thus, the transfer material may be contaminated at its back face or the performance of the transfer may be degraded. In order to overcome these problems, it is customary to provide a cleaning member for cleaning the transfer material supporting means before and after the copying operation. The cleaning member is often in the form of a brush as disclosed in U.S. Pat. No. 3,819,263. In general, the toner particles may be somewhat scattered around during the above cleaning step. The amount of scattered toner particles is larger particularly when a brush is used as cleaning means. On the other hand, there are corona dischargers used in transferring and charge-removing which are located near the transfer material supporting member. Thus, the above cleaning step must be carried out near these corona dischargers. As a result, the scattered toner particles may electrostatically be attracted to the discharging wires and shield plates of the corona dischargers under the influence of the charge produced by the corona dischargers or the potential generated by the applied voltage. This results in the creation of spark discharging. In the prior art, there have been proposed various approaches for preventing the scattered toner particles from depositing on the corona dischargers. One of these approaches is the use of a fan system for introducing air around the cleaning member. There was however no satisfactory approach in the prior art. It has been practical that the dischargers were manually cleaned by an operator.

SUMMARY OF THE INVENTION

It is an object of the present invention to overcome the above problems in the prior art which may occur when the transfer material supporting member is cleaned.

Another object of the present invention is to provide a method for preventing any toner particles scattered from the transfer material supporting member upon cleaning from depositing on the transfer and charge-removing dischargers.

The present invention accomplishing the above objects is characterized by setting the timing of actuation on a cleaning member for cleaning a transfer material supporting member and/or dischargers for transferring and for removing charges on the transfer material supporting member and the transfer material such that there is no overlap in timing between the operations of the cleaning member and dischargers.

DESCRIPTION OF THE PREFERRED EMBODIMENTS

The present invention will now be described in connection with an electrophotographic color copying machine by making reference to the drawings.

Figure 1:
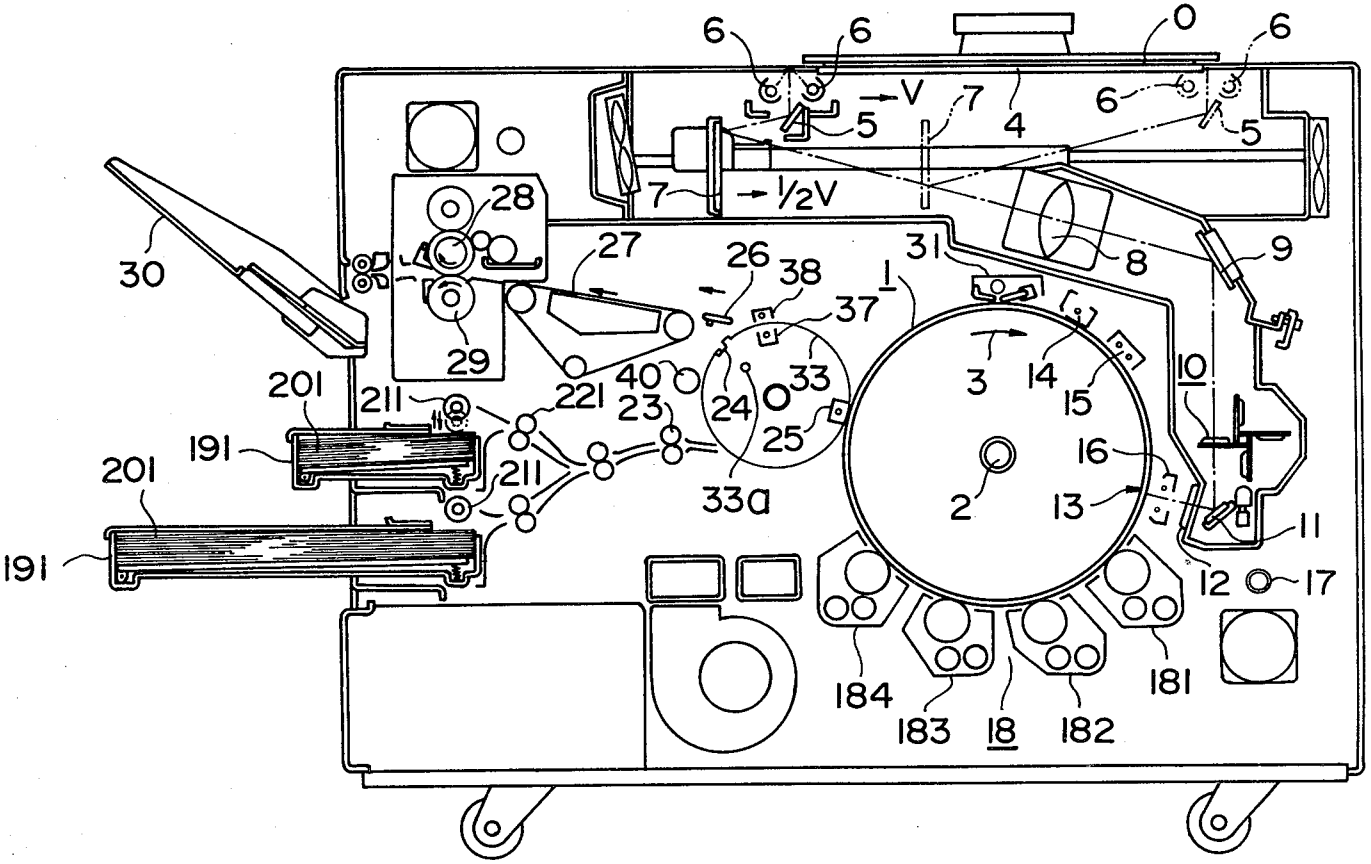
FIG. 1 is a side cross-section of an electrophotographic color copying machine to which the present invention is embodied.
Figure 2:
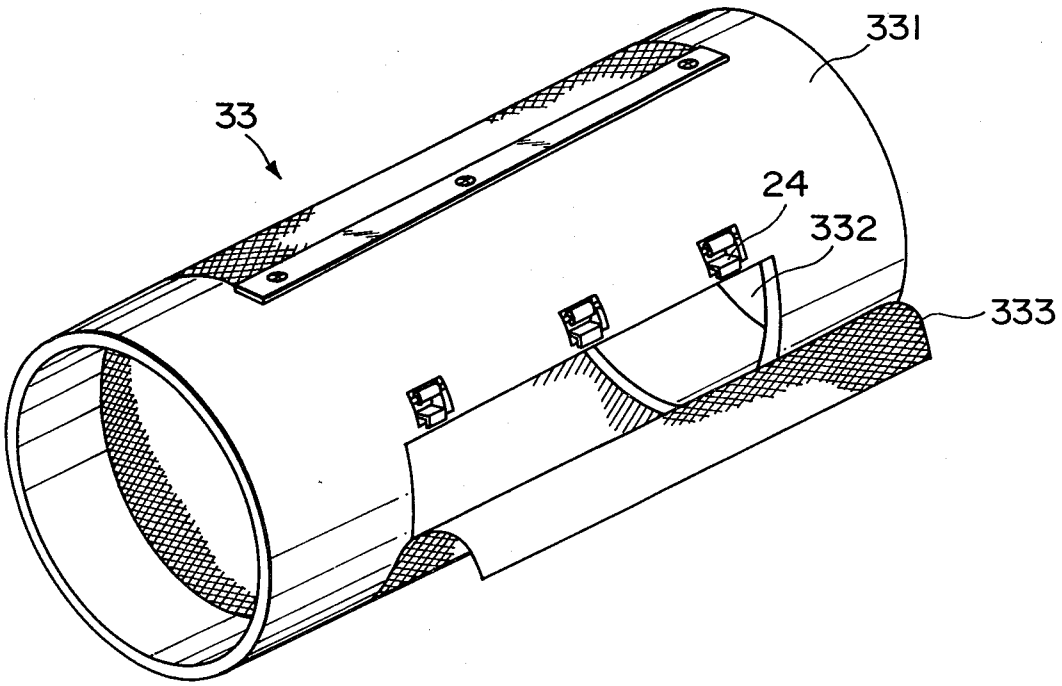
FIG. 2 is a perspective view of the transfer drum shown in FIG. 1.
Figure 3:
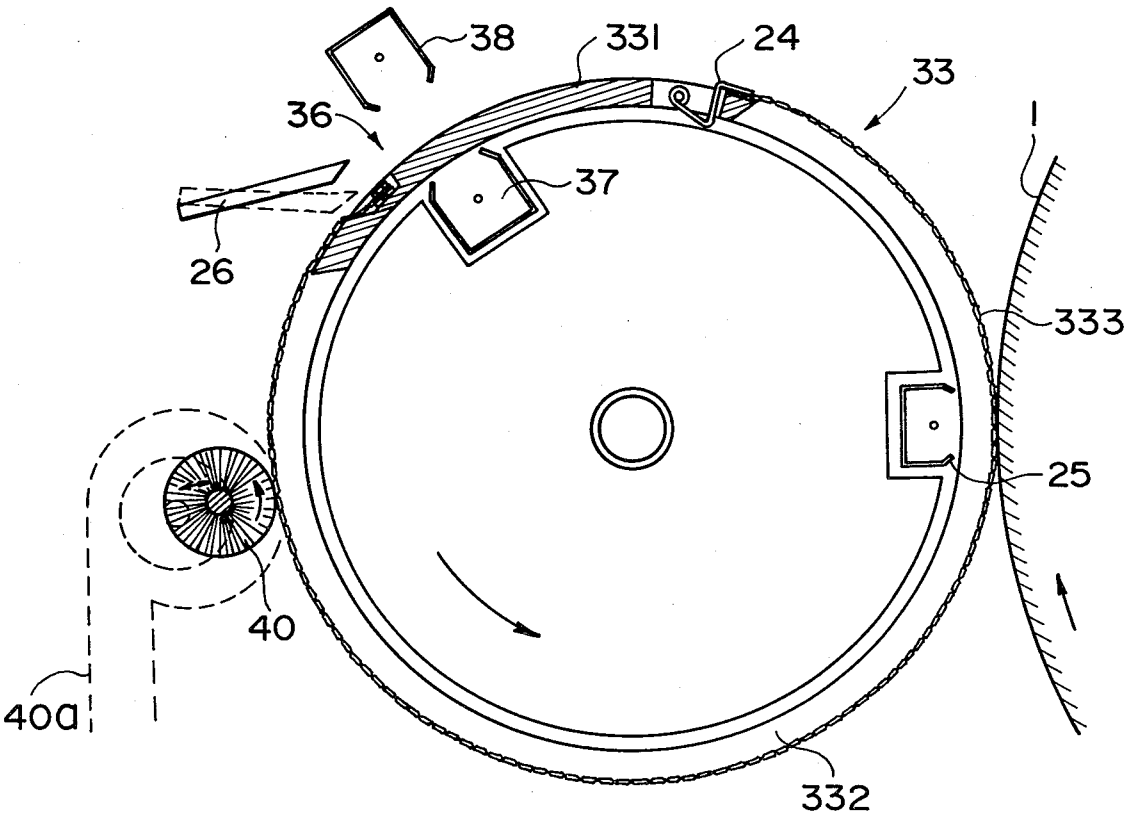
FIG. 3 is an enlarged side cross-sectional view of the transfer drum and its surrounding parts.

FIG. 1 is a side cross-section of the electrophotographic color copying machine, FIG. 2 is a perspective view of a transfer drum in the color copying machine and FIG. 3 is an enlarged side cross-sectional view showing the transfer drum and its surrounding parts.

Referring to FIG. 1, there is herein shown an electrophotographic type of photosensitive drum 1 comprising a drum-shaped conductive base, a photoconductive layer on the conductive base and an insulating surface layer on the photoconductive layer. The drum 1 is rotatably supported on a shaft 2. Under a copy instruction, the photosensitive drum 1 begins to rotate in the direction shown by an arrow 3. When the drum 1 is being rotated past a predetermined position, an original 0 placed on a platen of transparent glass 4 is irradiated by an illuminating lamp 6 associated with a first scanning mirror 5 as a unit. Reflective light from the original 0 is again reflected by a second scanning mirror 7. The first scanning mirror 5 is moved relative to the second scanning mirror 7 at a velocity rate of 2:1 so that an optical path length between the original 0 and a lens 8 will be maintained constant. The above reflective image light passes through the lens 8 and a third mirror 9 and then is color-separated by color separation filters 10. The image light further passes through a fourth mirror 11 and a dustproof sealing glass 12 and then is imaged on the drum 1 at an exposure station 13.

The drum 1 is electrically discharged by a charge removing device 14 and then positively charged, for example, to plus by a primary discharger 15. Thereafter, the drum 1 is exposed to the image irradiated by the illumination lamp 6 through a slit at the exposure station 13. At the same time, an AC discharging operation or a charge removing operation of the polarity opposite to the polarity of the primary charging (for example, negative) are carried out with respect to the drum 1 by a charge removing device 16. Thereafter, the drum 1 is exposed to an activating whole surface exposure lamp 17 throughout the surface of the drum to form an electrostatic latent image of high contrast on the drum 1.

The electrostatic latent image so formed on the photosensitive drum 1 is then visualized to provide a toner image by means of a development device 18. This development device 18 includes four developing sections, that is, a yellow developing section 181, a magenta developing section 182, a cyan developing section 183 and a black developing section 184. At the developing step, a selected developing section corresponding to any one of the color separation filters 10 which has been used at the exposure step is activated to provide a toner image having a selected color.

Transfer materials 201 in cassettes 191 are fed out one at a time into the copying machine by feed rollers 211. A transfer material from one of the cassettes 191 is generally timed by a first set of register rollers 221 and then accurately timed by a second set of register rollers 23 so that the leading edge of that transfer material will be positively gripped by a gripper 24 on a transfer drum 33. The transfer drum 33 provides a transfer material supporting member which will be described in detail hereinafter. As the transfer drum 33 is being rotated, the transfer material 201 is wound therearound and moved between a transfer discharger 25 and the photosensitive drum 1 whereat the toner image formed on the photosensitive drum 1 is transferred onto the transfer material. When the transfer drum 33 is rotated through a predetermined number of revolutions with the leading edge of the transfer material 201 being gripped by the gripper 24 on the transfer drum 33, toner images having required colors are successively transferred from the photosensitive drum 1 to the transfer material.

As best seen from FIG. 1, the copying machine includes two cassettes 191 respectively containing transfer materials of different sizes so that a transfer material to be fed can be changed from one of the sizes to the other.

Upon termination of the transferring step, the transfer material 201 is released from the gripper 24, separated from the transfer drum 33 by means of a separation pawl 26 and then guided onto a conveying belt 27 by the same separation pawl 26. Thereafter, the transfer material is conveyed into the nip between a pair of fixation rollers 28 and 29 whereat the toner images are fixed to the transfer material under pressure and heat. Finally, the transfer material is discharged into a tray 30. After the transferring step, the photosensitive drum 1 is cleaned at its surface by a cleaner 31 in the form of a resilient blade and then proceeds to the next cycle.

As shown in FIG. 2, the transfer drum 33 providing a transfer material supporting member comprises a cylindrical supporting member 331 including an opening 332 formed therein by cutting part of the cylindrical surface thereof. The opening 332 is covered by a screen 333 which is part of the transfer material supporting member. The screen 333 is held on the cylindrical supporting member 331 to have the same curvature as that of the above cylinder.

As shown in FIG. 3, charge removing dischargers 37 and 38 are disposed inside and outside of the transfer drum 33 at positions opposed to each other adjacent to the separation station 36 in which the separation pawl 26 is located. The charge removing dischargers 37 and 38 are effective to remove charges from the transfer material and the screen 333 so that any attracting force acting between the transfer material and the screen will be reduced and also to remove charge from the screen itself. A cleaning brush 40 is rotated in the direction shown by an arrow to clean the surface of the screen 333 after the transfer material has been separated from the transfer drum 33. The cleaning brush 40 is retractable from the screen 333 to a position shown by a broken line at the toner image transferring step so that the toner images will not be disturbed on the transfer material. Adjacent to the cleaning brush 40 is provided a duct **40*a* for sucking any toner particles which have been removed from the screen by the cleaning brush 40**.

However, it is difficult for the duct **40*a* completely to suck all the toner particles removed from the screen 333 by the cleaning brush 40. A portion of the removed toner particles may be scattered away from the duct 40*a*. It is particularly difficult for the duct 40*a* to suck any toner particles which have entered into the interior of the transfer drum through the screen 333. During the cleaning step, the dischargers 25, 37 and 38** are normally in operation. As a result, the scattered toner particles may electrostatically be attracted to and deposited on these dischargers to contaminate them.

Figure 4:
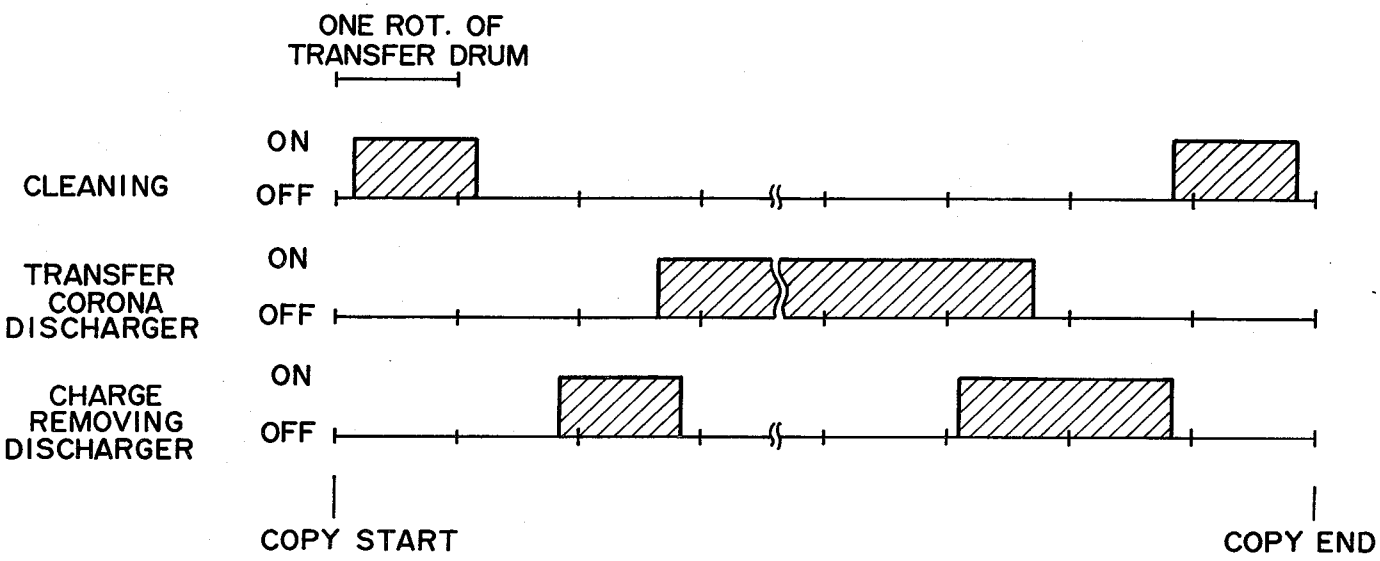
FIG. 4 is a chart illustrating an example of the operational timing of the cleaning member and various dischargers.

The present invention provides a solution to this problem. According to the present invention, the transfer discharger 25, charge removing dischargers 37, 38 and cleaning brush 40 are actuated in accordance with such a sequence as shown in FIG. 4. More particularly, the cleaning brush 40 is first actuated during one complete revolution of the transfer drum at the beginning of a copying operation to clean the transfer drum. Thereafter, the charge removing dischargers are actuated to remove charge from the transfer drum. Subsequently, the transfer discharger is actuated. The charge removing operation at the beginning of the copying operation after the cleaning step is effective to remove any triboelectric charge which may have been produced on the screen 333 at the cleaning step. Upon termination of the transferring step, the transfer discharger is deactivated and the charge removing dischargers are then activated to remove charges from the screen 333 and the toner particles deposited thereon during the next one revolution of the transfer drum. During the subsequent one revolution, the transfer drum 33 is cleaned by the cleaning brush 40 before this copying operation is terminated.

The starting point of the transfer drum in its one revolution as shown in FIG. 4 corresponds to the point **33*a* on the transfer drum 33 in FIG. 1. As seen from FIG. 4**, the operation of the transfer discharger may overlap that of the charge removing dischargers depending upon the arrangement of these dischargers. However, the operation of the dischargers must not overlap that of the cleaning brush. The above sequence can easily be realized by any suitable means, for example, by the use of sequence control signals which are generated in any sequence control apparatus assembled into the copying machine.

Although the present invention has been described with respect to the transfer drum used as a transfer material supporting member, the present invention may be applied to the other system using a belt-like transfer material supporting member. The cleaning step may be executed only upon termination of one copying cycle. The cleaning operation at the beginning of that copying cycle may be omitted.

Although the present invention has been described in connection with the copying machine, the present invention can be applied to any of the other various transfer type electrophotographic image recording systems.

As will be understood from the foregoing, the present invention is advantageous in that there is no overlap in timing between the cleaning step for the transfer material supporting member and the operations of the transfer and charge removing dischargers disposed adjacent to the transfer material supporting member so that the dischargers will not be contaminated by any toner particles resulting in the prevention of any creation of discharge failure and/or spark discharge.

Although the present invention has been described as to the insulating screen member mounted on the transfer material supporting member, any insulating sheet having no fine openings is usable. The cleaning means may be in the form of a blade or the like rather than the rotary brush. The present invention is most effective when the screen is used in combination with the rotary brush since the amount of the scattered toner particles is maximum. In the illustrated embodiment, the corona dischargers are used for both the transfer and charge removing steps. However, the discharger means for one of the transfer and charge removing steps may be any suitable means other than corona discharging means.

What is claimed is:

1. A method of cleaning a transfer material supporting means in an image forming apparatus, which apparatus performs the steps of forming a toner image on an image bearing member; supplying a transfer material onto an endless moving transfer material supporting means to transfer the toner image on said image bearing member to said transfer material; transferring the toner image on said image bearing member to said transfer material supported on said transfer material supporting means under the action of corona discharger means located opposite said supporting means; and separating and removing the transfer material from said transfer material supporting means after the transfer step; said method comprising cleaning said transfer material supporting means when no transfer material is on said transfer material supporting means and when said corona discharger means opposite said supporting means is not in operation.

2. A method of cleaning a transfer material supporting means in an image forming apparatus, which apparatus performs the steps of forming a toner image on an image bearing member; supplying a transfer material onto an endless moving transfer material supporting means to transfer the toner image on said image bearing member to said transfer material; transferring the toner image on said image bearing member to said transfer material supported on said transfer material supporting means; and separating and removing said transfer material from said transfer material supporting means under the action of corona discharger means located said supporting means after said transferring step; said method comprising cleaning said transfer material supporting means when no transfer material is on said transfer material supporting means and when said corona discharger means opposite said supporting means is not in operation.

3. A method of cleaning a transfer material supporting means in an image forming apparatus, which apparatus performs the steps of forming a toner image on an image bearing member; supplying a transfer material onto an endless moving transfer material supporting means to transfer the toner image on said image bearing member to said transfer material; transferring the toner image on said image bearing member to said transfer material supported on said transfer material supporting means under the action of corona discharger means located opposite said supporting means; and separating and removing said transfer material from said transfer material supporting means under the action of further corona discharger means after said transferring step; said method comprising cleaning said transfer material supporting means when no transfer material is on said transfer material supporting means and when said corona discharger means opposite said supporting means are not in operation.

4. A method as defined in claim 1, 2 or 3 wherein said cleaning is carried out by rotary brush means.

5. A method as defined in claim 1, 2 or 3 wherein said cleaning is carried out by rotary brush means and wherein said transfer material supporting means includes a transfer material holding member which is in the form of a screen.

6. A method as defined in claim 1, 2 or 3, further including the step of removing charge from said transfer material supporting means after it is cleaned.

7. A method as defined in claim 1, 2 or 3 wherein said image bearing member is a photosensitive member on which a latent image corresponding to a color separated image is formed, said latent image being then developed with a toner having a predetermined color.

* * * * *

UNITED STATES PATENT AND TRADEMARK OFFICE

CERTIFICATE OF CORRECTION

PATENT NO. : 4,483,610

DATED : November 20, 1984

INVENTOR(S) : YUSAKU TAKADA

It is certified that error appears in the above-identified patent and that said Letters Patent is hereby corrected as shown below:

Column 2, line 54, delete "to plus".

Column 6, line 3, Claim 2, insert --opposite-- between "located" and "said".

Signed and Sealed this

*Twenty-second* Day of *October 1985*

[SEAL]

*Attest:*

DONALD J. QUIGG

*Attesting Officer*

*Commissioner of Patents and Trademarks—Designate*